United States Patent [19]

Clark

[11] 3,956,602

[45] May 11, 1976

[54] PRE-GAPPED BREAKER POINT ASSEMBLY

[76] Inventor: William E. Clark, P.O. Box 702, Pinedale, Wyo. 82941

[22] Filed: Feb. 12, 1975

[21] Appl. No.: 549,419

[52] U.S. Cl. ..... 200/31 A
[51] Int. Cl.[2] ..... H01H 19/62
[58] Field of Search ..... 200/19 A, 27 A, 29, 200/30 R, 30 A, 30 AA, 31 R, 31 A, 249, 286

[56] References Cited

UNITED STATES PATENTS

| | | | |
|---|---|---|---|
| 2,742,539 | 4/1956 | Cory | 200/31 A |
| 3,025,364 | 3/1962 | Caramanna | 200/30 AA |
| 3,833,777 | 9/1974 | Clark | 200/31 A |

*Primary Examiner*—James R. Scott
*Attorney, Agent, or Firm*—J. Winslow Young; H. Ross Workman

[57] ABSTRACT

A pre-gapped breaker point assembly for a distributor of an internal combustion engine, the assembly having spacing blocks which are configured to pre-position the breaker contact points of the assembly at a correct spatial separation during placement of the breaker point assembly in the distributor of an internal combustion engine. The spacing blocks substantially eliminate subsequent adjustment of the contact points by suitably orienting the breaker point assembly with respect to the cam in the distributor.

2 Claims, 5 Drawing Figures

PRE-GAPPED BREAKER POINT ASSEMBLY

BACKGROUND

1. Field of the Invention

This invention relates to pre-gapped breaker point assemblies for distributors of internal combustion engines.

2. The Prior Art

Breaker point assemblies generally include a spring biased moveable arm and a stationary bracket both of which are supported on what is commonly referred to as a breaker plate within the distributor of an internal combustion engine. The moveable arm is reciprocatingly moved by a cam follower so as to provide a sequential contact between contact points of each of the moveable arm and the bracket. Electrical energy for ignition of the combustible fuel/air mixture in each cylinder of an internal combustion engine is suitably timed for the appropriate cylinder by the distributor. Adjustment of the maximum or preferred gap distance between the contact points as corresponding to the coincidence of the cam follower with a high point on the cam is necessary to assure that proper ignition timing is achieved in the selected cylinder.

As it is well known, contact points eventually become worn and in need of replacement. Replacement of worn contact points has historically been accomplished by replacement of the entire breaker point assembly in the distributor. Replacement is accompanied by a careful adjustment of the assembly within the distributor so as to achieve the appropriate gap distance between the contact points when the cam follower is at a high point on the cam. This procedure is generally time consuming and a relatively difficult task to perform for all but the most experienced mechanic.

What is needed is a pre-gapped breaker point assembly which permits accurate placement of the assembly within the distributor so as to achieve the correct gap distance with a minimal amount of subsequent adjustments required after the replacement breaker point assembly has been placed in the distributor. Preferably, the breaker point assembly should include spacing blocks which are suitably incorporated into the breaker point assembly during a stage of the manufacture. The spacing blocks should correctly position the breaker point assembly and more particularly, the cam follower, with respect to the cam so as to almost entirely eliminate subsequent adjustment of the contact gap. Such an invention is disclosed herein.

BRIEF SUMMARY AND OBJECTS OF THE INVENTION

The present invention is an improvement over my U.S. Pat. No. 3,833,777, issued Sept. 3, 1974, for PRE-GAPPED BREAKER POINT ASSEMBLIES. In the present invention multiple spacing blocks are used to suitably pre-position the breaker point assembly both within the distributor and with respect to the cam so as to achieve the appropriate gap distance between the contact points. The spacing blocks are removably positioned on the breaker point assembly during manufacture and may be removed therefrom once the breaker point assembly has been secured in the distributor. Advantageously, the present invention makes it possible for persons of relatively little mechanical skill to readily replace worn contact points while simultaneously achieving the correct spatial separation of the replacement contact points.

It is therefore a primary object of this invention to provide an improved breaker point assembly for a distributor of an internal combustion engine.

Another object of this invention is to provide an improved pre-gapped breaker point assembly having multiple spacing blocks emplaced during manufacture, the spacing blocks being oriented so as to correctly align the breaker point assembly and more particularly the cam follower with respect to the cam so as to obtain appropriate separation of the contact points when the cam follower is at a high point on the cam.

One further object of this invention is to provide a pre-gapped breaker point assembly incorporating improved multiple spacing blocks that may be removed from the assembly after the pre-gapped breaker point assembly has been installed in a distributor of an internal combustion engine.

These and other objects and features of the present invention will become more fully apparent from the following description and appended claims taken in conjunction with the accompanying drawing.

DETAILED DESCRIPTION OF THE PREFERRED EMBODIMENTS

Figure 1:
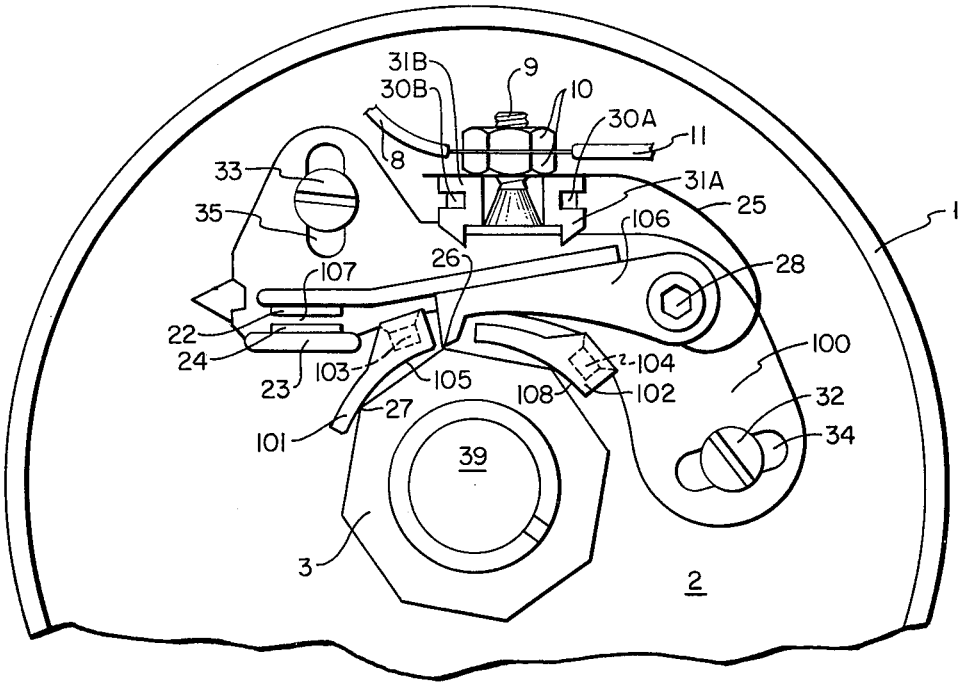
FIG. 1 is a plan view of a breaker point assembly incorporating the present invention, the breaker point assembly being shown in the environment of a distributor.
Figure 2:
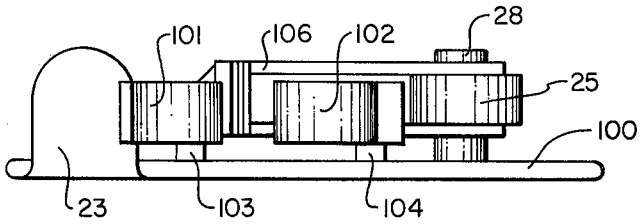
FIG. 2 is a side elevation of the breaker point assembly of FIG. 1.

The invention is best understood by reference to the figures wherein like parts are designated with like numerals throughout.

Replacement breaker point assemblies are generally available as a complete, pre-assembled unit and include a fixed bracket for a first contact point and a second contact point in juxtaposition therewith, the second contact point being reciprocatingly moved with respect to the first contact point. The second contact point is mounted on a spring-biased moveable arm with the moveable arm being actuated by a cam follower. The cam follower urges its respective contact point to its maximum separation distance from the first contact point when the cam follower is at a high point on the cam. Conventional distributors and breaker point assemblies incorporate adjustment screws for suitably positioning the breaker point assembly with respect to the cam so as to achieve the appropriate gap distance between the contact points coincident with a high point on the cam.

Referring now more specifically to the drawing, a conventional distributor housing is shown generally at 1 and includes a conventional breaker plate 2 mounted thereon. The breaker plate 2 is mounted in the distributor for limited rotation about the axis of rotation of a centrally located cam 3, the breaker plate 2 being rotated with respect to acceleration demands of the engine, as is conventional.

A pre-gapped breaker point assembly is shown generally at 100 and is attached to the breaker plate 2 by screws 32 and 33 which cooperate with elongated slots 34 and 35, respectively.

A stationary contact point 24 is mounted upon a flange 23 which forms an integral part of the breaker point assembly 100. A moveable contact point 22 is affixed to one end of a spring-biased moveable arm 106 which is pivotally supported by a pivot post 28. Arm 106 includes a cam follower 26 and a spring 25 which urges cam follower 26 against cam 3. Spring 25 cooperates between the moveable arm 106 and a terminal post 9 and provides electrical contact between the terminal post 9 and the contact point 22, the remainder of removable arm 106 being maintained in electrical isolation from breaker point assembly 100. Cam follower 26 is fabricated from an insulative material such as plastic so as to maintain the electrical isolation of contact point 22 from breaker point assembly 100.

Terminal post 9 is insulatively supported by a U-shaped insert, the ends of which are shown herein as 31A and 31B, the U-shaped insert being supported upon upright posts 30A and 30B which are an integral part of breaker plate assembly 100.

A condenser lead 8 and a housing outlet electrical lead 11 (both of which are shown broken away for purposes of simplicity) are secured to terminal post 9 by split nut 10.

Breaker point assembly 100 includes at least two flanges 103 and 104 shown herein as in broken lines, both of which support spacing blocks 101 and 102, respectively. Flanges 103 and 104 are preferably formed as an integral part of breaker plate assembly 100 so as to rigidly support each of spacing blocks 101 and 102, respectively. Spacing blocks 101 and 102 serve to suitably pre-position the breaker point assembly 100 wih respect to breaker plate 2 and cam 3.

Each of spacing blocks 101 and 102 are positioned so as to rest against at least one high point or lobe 27 on cam 3, thereby correctly positioning breaker point assembly 100 on breaker plate 2 when the cam follower 26 is coincident with lobe 27 on cam 3. Accordingly, with the breaker point assembly 100 correctly positioned on breaker plate 2 with respect to cam 3 one has to merely tighten screws 32 and 33 to secure assembly 100 to breaker plate and obtain an appropriate gap distance 107 between contact points 22 and 24.

Spacing blocks 101 and 102 have curvilinear surfaces 105 and 108, respectively, which surfaces are concentric with a circle scribed by the cam lobes 27 as cam 3 is axially rotated by rotation of shaft 39 to which cam 3 is affixed.

Figure 3:
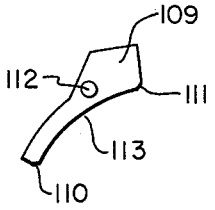
FIG. 3 is a plan view of a second preferred embodiment of one of the spacing blocks.

Referring now more particularly to FIG. 3, another presently preferred embodiment of one of the spacing blocks is shown at 109 and includes a blind bore 112 which may be serrated, tapered or otherwise prepared to serve as an engagement means for receiving a removal tool (not shown) for removal of spacing block 109 from the assembly. Spacing block 109 includes chamfer or beveled corners 110 and 111 which thereby serve to eliminate possible rotational interference between the cam lobes of cam 3 and the semi-cylindrical abutment surface 113. Spacing block 109 is substantially identical in function to spacing block 101 and 102 with the exception of the chamfer corners and the removal tool engagement means or blind bore 112.

Figure 4:
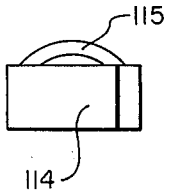
FIG. 4 is a side elevation of an alternate embodiment of a spacing block.

Referring now to FIG. 4, spacing block 114 is shown and incorporates therein a further modification of a spacing block by including a loop 115 attached at its top surface. Loop 115 provides a handle for easy removal of spacing block 114 from the breaker point assembly 100 after breaker point assembly 100 has been suitably pre-positioned on breaker plate 2. Spacing block 114 is also substantially identical, as is spacing block 109 (FIG. 3) to the spacing blocks 101 and 102.

Figure 5:
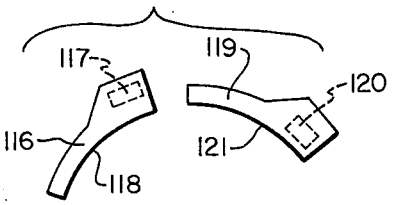
FIG. 5 is a plan view of another presently preferred embodiment of the spacing blocks of the present invention.

With particular reference now to FIG. 5, a pair of juxtapositioned spacing blocks 116 and 119 is shown with semi-cylindrical surfaces 118 and 121 describing a proportion of an arc which is concentric with the circle scribed by cam lobes 27, for example, of cam 3. It is particularly noted, however, in this particular configuration that openings 117 and 120 of spacing blocks 116 and 119, respectively, and shown herein in broken lines, are displaced relative to the position that each occupies in its respective spacing block. With this configuration, it is possible to suitably pre-position each of spacing blocks 116 or 119 relative to cam 3 to thereby suitably achieve alternate predetermined positions of the breaker point assembly 100 and, correspondingly, the gap distance 107 between contact points 22 and 24. Spacing blocks 116 and 119 are substantially identical in function and method of attachment to breaker point assembly 100 as are spacing blocks 101 and 102 with the major difference being in the relative displacement of the attachment slots 117 and 120, respectively.

From the foregoing it is readily apparent that the present invention provides a novel, simplified, and improved pre-gapped breaker point assembly wherein the spacing blocks are incorporated into the assembly during manufacture and are pre-adjusted so as to provide the optimum gap distance 107 when the assembly 100 is attached to the breaker plate 2.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States letters patent is:

1. A pre-gapped breaker point assembly for a distributor of an ignition system of an internal combustion engine, the assembly being adapted to be adjustably mounted on a moveable mounting plate in said distributor, the breaker point assembly being secured in proximity to a cam of said distributor, the assembly having a cam follower resiliently urged into contact with said cam and having an arm attached thereto, the arm terminating in a first breaker contact point, the cam follower being operable between said cam and said moveable arm so as to intermittently separate said first contact point from second contact point coincident with a high point on said cam, the first contact point being electrically isolated from the breaker point framework and the second contact point being in electrical contact with said breaker point framework; the improvement comprising:

means for independently mounting at least two separately mountable spacing blocks on said breaker point assembly, each of said mounting means comprising a flange on the breaker point assembly and upon which flanges said spacing blocks are removeably mounted, said spacing blocks comprising a first and a second spacing block, each spacing block comprising at least one abutment surface adapted to be placed in juxtaposition against at least one high point on said cam to thereby selectively achieve a suitable predetermined position of said breaker point assembly with respect to the breaker plate and in coincident with the cam follower at a third high point on said cam and thereby establish a predetermined maximum separation of said first and said second contact points; and a substitute spacing block for the first spacing block and mountable upon the flange to change the relative position of the breaker point assembly with respect to the cam without affecting the position of the second spacing block on the breaker point assembly.

2. The improvement of claim 1 wherein said means for independently mounting said spacing blocks comprise at least two flanges on said breaker point assembly, each flange dimensionally configurated to accommodate removeably mounting said spacing blocks upon said breaker point assembly so as to selectively permit independent removal of said spacer blocks after the breaker point assembly has been secured to said mounting plate.

* * * * *